US007324075B2

(12) United States Patent
Sano et al.

(10) Patent No.: US 7,324,075 B2
(45) Date of Patent: Jan. 29, 2008

(54) PIXEL CIRCUIT AND DISPLAY DEVICE

(75) Inventors: Keiichi Sano, Taipei (TW); Koji Marumo, Gifu (JP); Masayuki Koga, Gifu (JP); Kenya Uesugi, Ohgaki (JP); Michiru Senda, Gifu (JP); Kuni Yamamura, Gifu (JP)

(73) Assignee: Sanyo Electric Co., Ltd. (JP)

( * ) Notice: Subject to any disclaimer, the term of this patent is extended or adjusted under 35 U.S.C. 154(b) by 601 days.

(21) Appl. No.: 10/857,406

(22) Filed: May 28, 2004

(65) Prior Publication Data

US 2005/0017929 A1 Jan. 27, 2005

(30) Foreign Application Priority Data

May 29, 2003 (JP) ..... 2003-152158
Nov. 7, 2003 (JP) ..... 2003-378569
May 25, 2004 (JP) ..... 2004-154072

(51) Int. Cl.
*G09G 3/30* (2006.01)

(52) U.S. Cl. ..... 345/77; 345/78; 345/208; 345/211; 345/690; 315/169.1; 315/169.3

(58) Field of Classification Search ..... 345/76–80, 345/82, 205, 206, 208, 211–214, 690; 315/169.1–169.3
See application file for complete search history.

(56) References Cited

U.S. PATENT DOCUMENTS 6,518,962 B2 * 2/2003 Kimura et al. ..... 345/211
6,542,138 B1 * 4/2003 Shannon et al. ..... 345/76
6,583,775 B1 * 6/2003 Sekiya et al. ..... 345/76
6,693,610 B2 * 2/2004 Shannon et al. ..... 345/76
6,858,991 B2 * 2/2005 Miyazawa ..... 315/169.3
6,903,731 B2 * 6/2005 Inukai ..... 345/204
7,106,290 B2 * 9/2006 Inukai et al. ..... 345/92

FOREIGN PATENT DOCUMENTS

WO WO 98/48403 10/1998

* cited by examiner

*Primary Examiner*—Henry N Tran
(74) *Attorney, Agent, or Firm*—Cantor Colburn LLP

(57) ABSTRACT

When a switching TFT is switched on, a data voltage on a data line is stored in a storage capacitor as a gate voltage of a driver TFT. In this state, a voltage on a pulse drive line is caused to fall. AMOS type capacity element having a second electrode connected to a reference voltage is connected to a gate of the driver TFT. The MOS type capacity element is in an ON state before a fall of the pulse drive line and becomes an OFF state during the fall, and a capacitance changes at the switching of ON state to the OFF state. Therefore, the slope of fall of the gate voltage changes, and the gate voltage after the fall on the pulse drive line can be corrected corresponding to the variation in the threshold values among driver TFTs.

11 Claims, 13 Drawing Sheets

PIXEL CIRCUIT AND DISPLAY DEVICE

BACKGROUND OF THE INVENTION

1. Field of the Invention

The present invention relates to a pixel circuit having an emissive element such as an organic electroluminescence (hereinafter simply referred to as "EL") element and to a display device in which the pixel circuits are provided in a matrix form.

2. Description of the Prior Art

Conventional organic EL panels which use an organic EL element as an emissive element are known, and much research has been directed at developing these organic EL panels. In such an organic EL panel, organic EL elements are arranged in a matrix form and the light emission of each of the organic EL elements is individually controlled to achieve a display. In particular, in an active matrix organic EL panel, because a thin film transistor (hereinafter simply referred to as "TFT") for controlling display is provided in each pixel and the light emission from each pixel can be controlled by controlling the operation of the TFT, a highly precise display can be achieved.

FIG. 14 shows an example of a pixel circuit in an active matrix organic EL panel. A data line to which a data voltage indicating brightness of a pixel is supplied is connected to a gate of a driver TFT 12 through an n-channel switching TFT 10 having its gate connected to a gate line. In addition, one electrode of a storage capacitor 14 having the other electrode connected to a capacity power supply line is connected to the gate of the driver TFT 12. The storage capacitor 14 stores the gate voltage of the driver TFT 12.

A source of the driver TFT 12 is connected to an EL power supply and a drain of the driver TFT 12 is connected to an anode of an organic EL element 16. A cathode of the organic EL element 16 is connected to a cathode power supply.

Pixel circuits each having such a structure are arranged in a matrix form. A gate line provided for each horizontal line (row) becomes an H level at a predetermined timing and the switching TFTs 10 in the corresponding row are switched on. Because data voltages are sequentially supplied onto the data line in this state, the data voltages are supplied to and stored in the storage capacitors 14 so that these voltages are maintained even after the gate line becomes an L level.

The driver TFT 12 operates according to the voltage stored in the storage capacitor 14 and a corresponding drive current flows from the EL power supply through the organic EL element 16 to the cathode power supply, so that light is emitted from the organic EL element 16 corresponding to the data voltage.

Then, the gate lines are sequentially set to an H level so that an input video signal is sequentially supplied to corresponding pixels as a data voltage. Organic EL elements 16 arranged in a matrix form emit light based on the data voltage and a display is achieved corresponding to the video signal.

In a pixel circuit having such a structure, however, when the threshold voltages of the driver TFTs 12 in the pixel circuits arranged in a matrix form vary, the luminance of organic EL elements also varies, resulting in a problem in that the display quality is impaired. It is difficult to obtain completely identical characteristics for all TFTs in the pixel circuits in the overall display panel or to prevent variations in the threshold values for switching on and off.

Therefore, there is a desire to prevent influences, to the display, of variations in threshold values among driver TFTs.

Various techniques have been proposed for a circuit for preventing influences to variation in threshold values among TFTs (for example, PCT Patent Publication No. WO/98/48403).

In that structure, however, a circuit for compensating the variation in threshold values is required. When such a circuit is employed, the number of components in a pixel circuit is increased and there had been a problem in that the aperture ratio is reduced. When a compensation circuit is added, there also is a problem in that the peripheral circuit for driving the pixel circuit must also be changed.

The present invention therefore advantageously provides a pixel circuit in which a variation in the threshold voltages among driver transistors can be effectively compensated with a simple modification.

SUMMARY OF THE INVENTION

According to one aspect of the present invention, there is provided a pixel circuit comprising a storage capacitor for receiving a data voltage on a first electrode and storing the data voltage; a driver transistor having its gate connected to the first electrode of the storage capacitor and in which an amount of current is controlled based on a voltage on the first electrode of the storage capacitor; an emissive element which emits light corresponding to a current flowing through the driver transistor; a first control signal line connected to a second electrode of the storage capacitor and to which a predetermined voltage or pulse-shaped signal is input; and a MOS type capacity element having a first electrode connected to a gate of the driver transistor and a second electrode connected to a second control signal line to which a predetermined voltage or pulse-shaped signal is input, wherein a capacitance of the MOS type capacity element changes in response to a change in voltage on the first or second control signal line.

The on and off states of the MOS type capacity element change when the voltage on the first or second control signal line changes, so that the capacity of the MOS type capacity element changes. With the change in the capacitance value, it is possible to compensate the variation in threshold values among driver transistors. Examples of structures that can be used as the MOS type capacity element include, for example, a TFT, a MIS transistor, and a MOS transistor.

According to another aspect of the present invention, it is preferable that, in the pixel circuit, after the data voltage is stored in the storage capacitor, the state of the MOS type capacity element is changed from the ON state to the OFF state by changing the voltage on the first or second control signal line.

According to another aspect of the present invention, it is preferable that, in the pixel circuit, the MOS type capacity element has a threshold voltage similar to that of the driver transistor.

Because the MOS type capacity element can be formed through the same process as, and in proximity to, the driver TFT, it is relatively easy to configure the MOS type capacity element and the driver TFT to have the same characteristics. When the threshold voltages of the MOS type capacity element and of the driver TFT are similar, the compensation of variation in threshold voltages can easily be achieved taking advantage of the similar characteristics.

According to another aspect of the present invention, it is preferable that, in the pixel circuit, at least one of a source and a drain of the MOS type capacity element is connected to a gate of the driver transistor and a gate of the MOS type capacity element is connected to the second control signal line.

According to another aspect of the present invention, it is preferable that, in the pixel circuit, one of a source and a drain of the MOS type capacity element is connected to a supply source of a data signal, another one of the source and the drain is connected to a gate of the driver transistor, and a gate of the MOS type capacity element is connected to a second control signal line.

Similar advantages can be obtained by replacing the MOS type capacity element with a MOS transistor.

According to another aspect of the present invention, it is preferable that, in the pixel circuit, the state of the MOS type capacity element is changed from the ON state to the OFF state with a change in the voltage on the first or second control signal line, and, at the same time, the state of the driver transistor is changed from the OFF state to the ON state to allow the emissive element to emit light.

According to another aspect of the present invention, it is preferable that, in the pixel circuit, a drive power supply line which is connected to the driver transistor also functions as the second control signal line. With such a configuration, a dedicated second control signal line is unnecessary.

According to another aspect of the present invention, it is preferable that, in the pixel circuit, the driver transistor and the MOS type capacity element are p-channel thin film transistors.

According to yet another aspect of the present invention, it is preferable that, in the pixel circuit, the emissive element is an electroluminescence element.

According to another aspect of the present invention, it is preferable that, in a display device, the pixel circuits as described above are provided in a matrix form.

As described, according to the present invention, the ON and OFF states of the MOS type capacity element are changed by a change in the voltage on a first or second control signal line (for example, a pulse-drive line) and the capacitance value of the MOS type capacity element changes. Based on the change in the threshold value of the MOS type capacity element, the voltage at which the ON and OFF states of the MOS type capacity element are switched is changed.

Because a change in a gate voltage of the driver transistor corresponding to the change in the pulse drive line is determined based on the capacitance value of the MOS type capacity element, the gate voltage changes corresponding to any change in the threshold value of the MOS type capacity element. By designing the MOS type capacity element and the storage capacitor so that the gate voltage of the driver transistor changes to counterbalance variation in threshold values among driver transistors, it is possible to reduce influence, on the driver current, of variations in threshold values among driver transistors.

DESCRIPTION OF PREFERRED EMBODIMENTS

Figure 1:
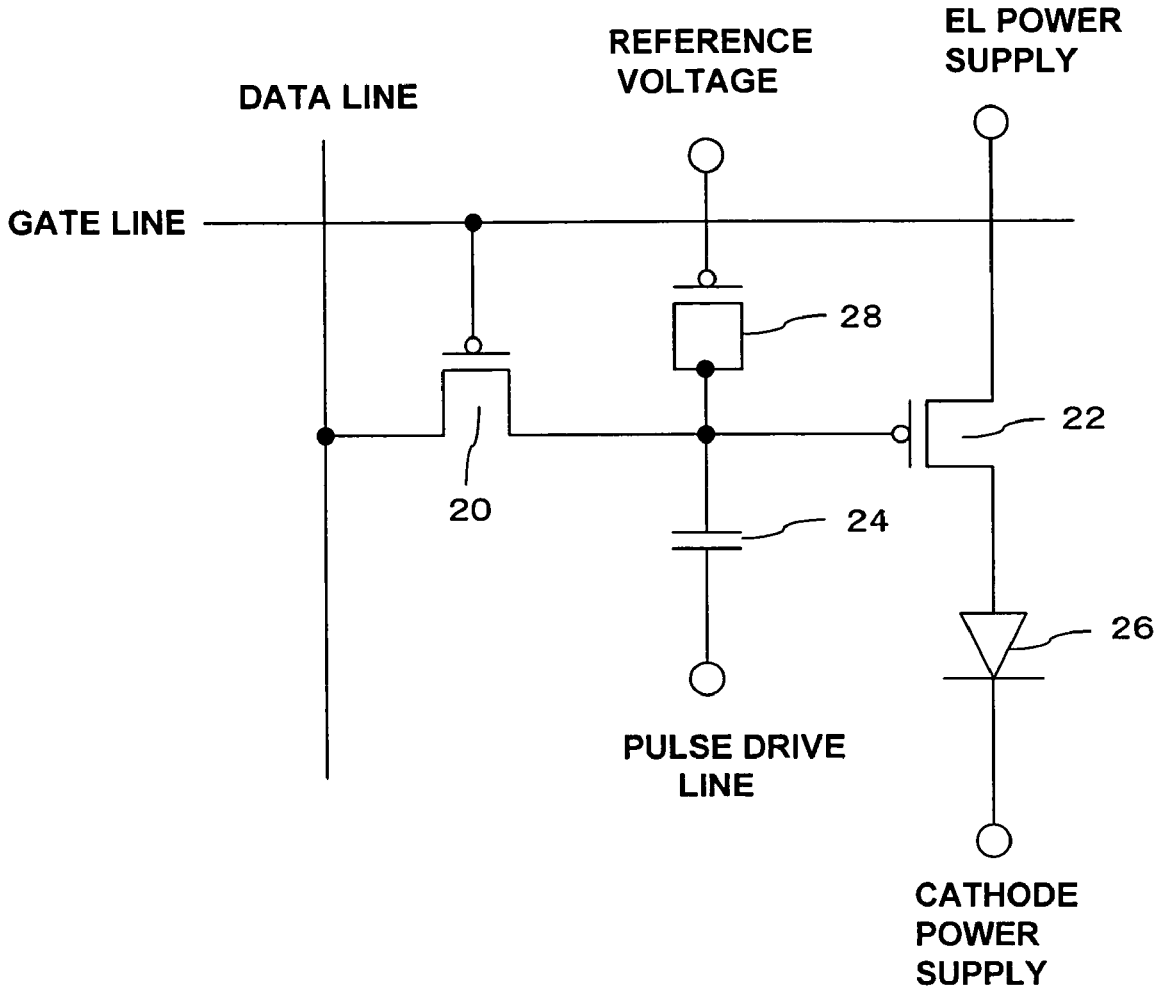
FIG. 1 is a diagram showing a structure of a pixel circuit according to a preferred embodiment of the present invention.

Preferred embodiments of the present invention will now be described referring to the drawings.

FIG. 1 is a diagram showing a structure of a pixel circuit for one pixel according to a preferred embodiment of the present invention. A drain of a p-channel switching TFT 20 is connected to a data line extending along a vertical (scan) direction. A gate of the switching TFT 20 is connected to a gate line extending along a horizontal (scan) direction and a source of the switching TFT 20 is connected to a gate of a p-channel driver TFT 22. A first electrode of a storage capacitor 24 is connected to a gate of the driver TFT 22 to which the source of the switching TFT 20 is connected and a second electrode of the storage capacitor is connected to a pulse drive line. The pulse drive line (first control signal line) is a line extending along the horizontal direction similar to a capacitor power supply line.

A source of the driver TFT 22 is connected to an EL power supply line extending along a vertical (scan) direction and a drain of the driver TFT 22 is connected to an anode of an organic EL element 26. A cathode of the organic EL element 26 is connected to a cathode power supply. In a typical structure, the cathode of the organic EL element 26 is formed to be common to all pixels and is connected to a cathode power supply of a predetermined potential.

A first electrode of a p-channel MOS type capacity element 28 having its gate terminal set at a voltage of a reference power supply line (second control signal line) of a predetermined potential is connected to the gate of the driver TFT 22. In this configuration, the MOS type capacity element 28 has a source region, a channel region, and a drain region similar to a typical TFT, but one electrode of a source or a drain and a gate electrode are connected to a predetermined portion so that the MOS type capacity element 28 is used simply as a gate capacitor.

The MOS type capacity element 28 may also have a structure comprising a channel region and an impurity region, and in which an electrode corresponding to the impurity region and the gate electrode are connected to a predetermined portion. Example structures of the MOS type capacity element 28 include, for example, a MOS transistor, a MIS transistor, and a TFT type device.

Pixel circuits each having a structure as described above are arranged in a matrix form. A gate line of a horizontal line becomes an L level at a timing in which a video signal of corresponding horizontal line is input and the switching TFTs 20 of that row are switched on. In this state, a video signal is sequentially supplied as a data voltage onto the corresponding data line. The data voltage is supplied to and stored in the storage capacitor 24, and the gate voltage of the driver TFT 22 is maintained even after the gate line becomes an H level and the switching TFT 20 is switched off.

According to the voltage stored in the storage capacitor 24, the driver TFT 22 is operated and a corresponding drive current flows from the EL power supply through the organic EL element 26 to the cathode power supply, thus allowing the organic EL element 26 to emit light based on the data voltage.

Then, by sequentially setting the gate lines to the L level and sequentially supplying an input video signal to a corresponding pixel as a data voltage, the organic EL elements 26 arranged in a matrix form emit light corresponding to the data voltage and a display is achieved corresponding to the video signal.

In this structure, the driver TFT 22 is switched on according to a difference between the voltage of the EL power supply and a gate voltage, that is, Vgs, and a corresponding drive current flows through the driver TFT 22. In other words, a current starts to flow through the driver TFT 22 when Vgs exceeds a threshold voltage Vth of the TFT which is determined by the characteristics of the TFT, with the amount of drive current determined by a difference between a gate voltage and a threshold voltage. However, because setting the threshold voltages of a plurality of driver TFTs 22 arranged in a matrix form to be completely identical to each other remains a prohibitively difficult task, variations in threshold voltages among pixels cannot practically be prevented. Therefore, the display brightness varies according to the variation in the threshold voltages among the driver TFTs 22.

In the present embodiment, a MOS type capacity element 28 is connected to the gate of the driver TFT 22 and a second electrode of the storage capacitor 24 is connected to the pulse drive line in order to compensate for the variation in threshold voltages of the driver TFTs 22.

The pulse drive line is at an H level during when the switching TFT 20 is switched on and a data voltage is written. After the writing of the data voltage (charging to the storage capacitor 24) is completed and the switching TFT 20 is switched off, the pulse drive line becomes an L level, which causes the gate voltage of the driver TFT 22 to drop from the data voltage by a predetermined amount and a drive current corresponding to the new voltage flows through the driver TFT 22.

The MOS type capacity element 28 is provided in each pixel and is formed adjacent to the driver TFT 22 of the corresponding pixel through the same steps as the driver TFT 22. Therefore, the driver TFT 22 and the MOS type capacity element 28 have approximately identical impurity concentrations and the like, and, consequently, approximately identical threshold voltages. A reference voltage (Vref=$V_{G28}$) to be applied to the gate of the MOS type capacity element 28 is set so that the channel region of the MOS type capacity element 28 changes from the ON state to the OFF state when the voltage on the pulse drive line changes from an H level to an L level, and may be a constant voltage or a signal having an inverted phase from that of the pulse drive voltage.

Figure 2:
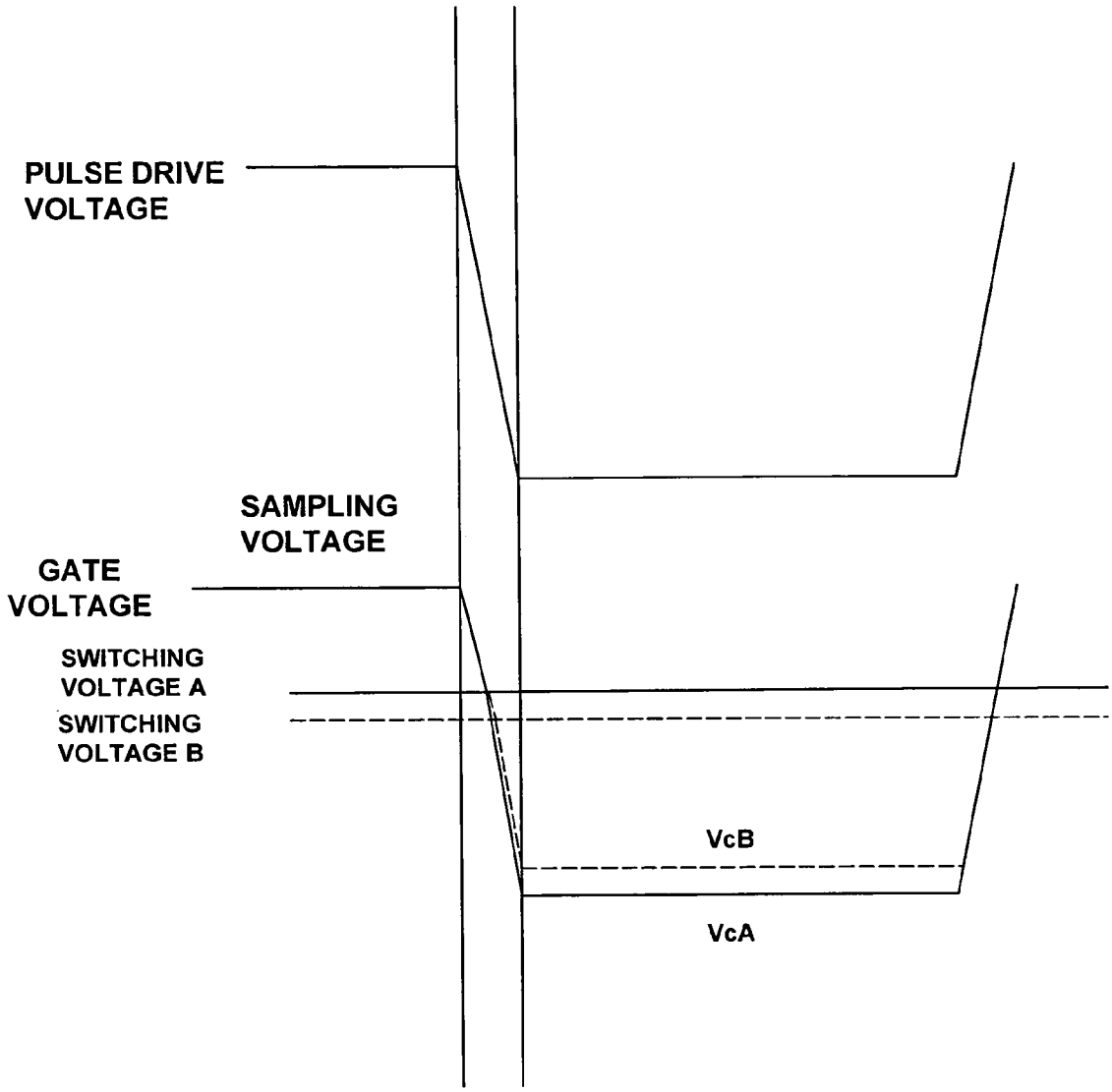
FIG. 2 is a diagram showing a change of states of a gate voltage.

As shown in FIG. 2, the pulse drive voltage on the pulse drive line changes from the H level to the L level. When this transition occurs, the voltage at a node $T_{G22}$ in FIG. 1, that is, the gate voltage of the driver TFT 22 ($V_{G22}$) is reduced corresponding to the pulse drive voltage. When the gate voltage ($V_{G22}$) is reduced and a potential difference (|Vref-$V_{G22}$|) between the reference voltage (Vref) and the gate voltage ($V_{G22}$) becomes smaller than the absolute value of a threshold voltage of the MOS type capacity element 28 (Vth28), the state of the MOS type capacity element 28 which is constructed as a p-conductive type structure changes from the ON state to the OFF state. With this process, the capacitance of the MOS type capacity element 28 is reduced, and, consequently, the influence of a change in the pulse drive voltage input through the storage capacitor 24 becomes more significant, resulting in an increased slope for the reduction in the gate voltage. In general, the potential of the node $T_{G22}$ changes based on the change in the pulse drive voltage. Because the capacitance value of the MOS type capacitance element 28 is larger when the MOS type capacity element 28 is in the ON state and is smaller when the MOS type capacity element 28 is at the OFF state, when the MOS type capacity element 28 is switched from a state in which the capacitance is large to a state in which the capacitance is small, the slope of the change of the potential of the node $T_{G22}$ (gate potential of the TFT 22) becomes large.

When a switching voltage from the ON state to the OFF state of the MOS type capacity element 28 is a "switching voltage A" shown in FIG. 2, the gate voltage $V_{G22}$ changes as shown by a solid line on FIG. 2. That is, the gate voltage changes (decreases) with a first slope until the gate voltage reaches the switching voltage A and then changes (decreases) with a second slope. When the pulse drive voltage becomes the L level, the gate voltage $V_{G22}$ is set at a correction voltage VcA. Because the switching voltage in which the MOS type capacity element 28 is switched on and off is determined by a difference from the reference voltage Vref, the switching voltages A and B respectively equal to voltages in which an absolute value of the threshold voltage Vth28 of the MOS type capacity element 28 is added to Vref (Vref+|Vth28|).

When the absolute value of the threshold voltage $V_{th28}$ of the MOS type capacity element 28 is small and the switching voltage is a "switching voltage B" which is lower than the "switching voltage A", the gate voltage $V_{G22}$ changes as shown by a dotted line in FIG. 2. More specifically, the gate voltage $VG_{22}$ changes (decreases) with a first slope until the gate voltage $V_{G22}$ reaches the switching voltage B and then changes (decreases) with a second slope. When the pulse drive voltage becomes the L level, the gate voltage $V_{G22}$ is set at a correction voltage VcB. In other words, even when the same data voltage (sampling voltage) is supplied to the node $T_{G22}$, the gate voltage which is set by the pulse drive is set at a higher voltage (a voltage closer to an OFF voltage in a p-ch TFT) as the threshold voltage $V_{th28}$ of the MOS type capacity element 28 is lower (as the absolute value $|V_{th28}|$ is lower and the MOS type capacity element 28 is easily switched on).

As described, the threshold voltage $V_{th22}$ of the driver TFT 22 in each pixel is identical to the threshold voltage $V_{th28}$ of the MOS type capacity element 28 formed in the same pixel and close proximity to the driver TFT 22. Therefore, when the threshold voltage $V_{th22}$ of the driver TFT 22 is at a "threshold voltage $V_{th22}$1", the gate voltage $V_{G22}$ is set at a correction voltage $VC_{th22}$1 corresponding to the $V_{th22}$1 and when the threshold voltage $V_{th22}$ of the driver TFT 22 is a "threshold voltage $V_{th22}$2", the gate voltage $V_{G22}$ is set at a correction voltage $Vc_{th22}$2 corresponding to the $V_{th22}$2. In the illustrated configurations, the differences between the threshold voltage $V_{th22}$ and the gate voltage $V_{G22}$ are almost identical in all pixels. In other words, when the data voltage is constant through setting of the size of the MOS type capacity element 28, the reference voltage value ($V_{G28}$), size of the driver TFT 22, and capacitance value of the storage capacitor 24, even if the threshold voltages $V_{th22}$ of the driver TFTs 22 differ from each other, it is possible to obtain a constant difference between the threshold voltage $V_{th22}$ and the gate voltage $V_{G22}$ among pixels, to thereby remove influences of variation in threshold voltages.

Figure 3:
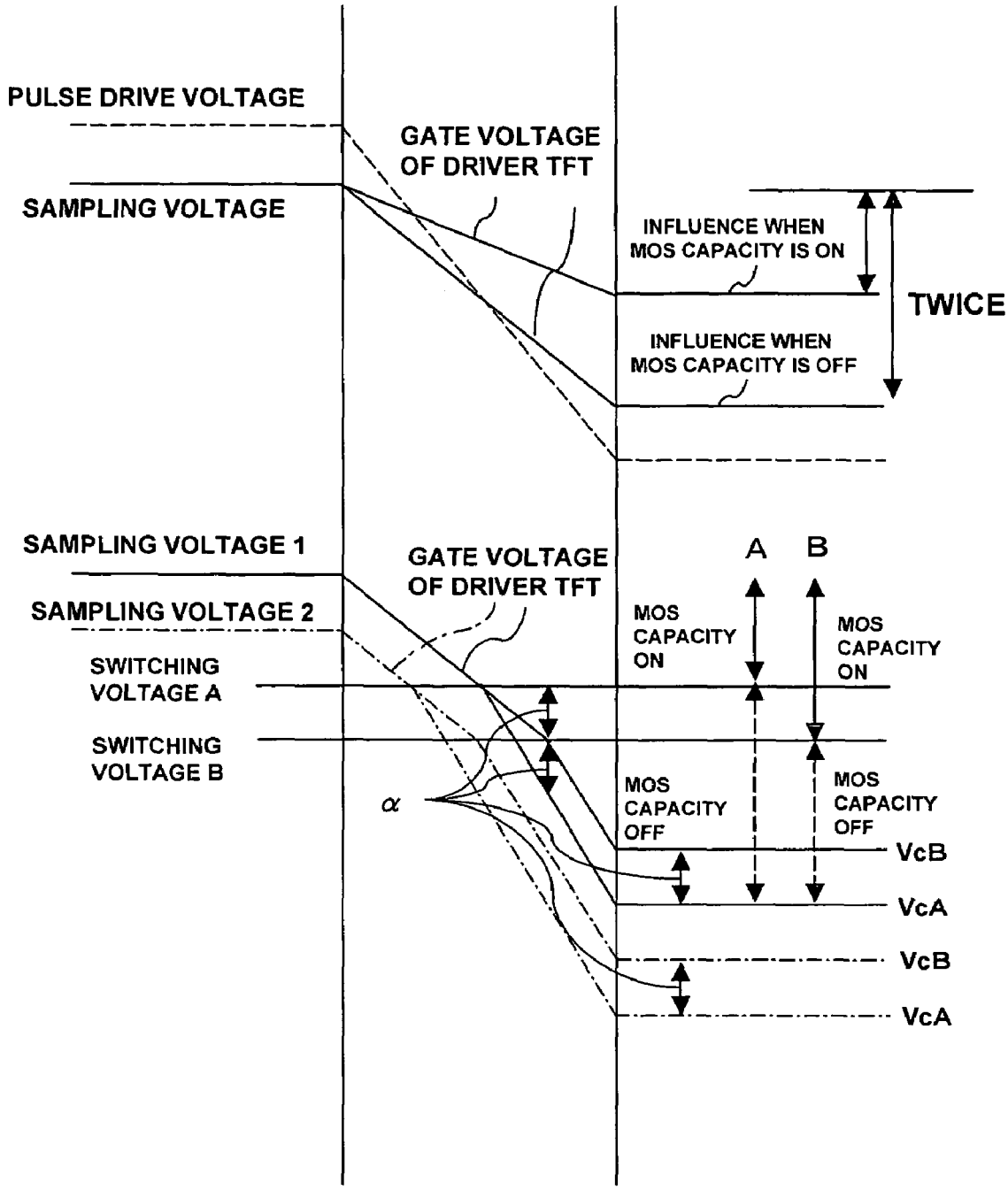
FIG. 3 is a diagram showing a relationship between a change in a switching voltage and a change in a gate voltage.

In order to perform such compensation, a conditions is set such that the second slope is twice the first slope in FIG. 2. This condition setting will now be described referring to FIG. 3. As shown in FIG. 3, when the MOS type capacity element 28 is at the ON state, the capacitance value is larger compared to the case when the MOS type capacity element 28 is at the OFF state. Therefore, influences due to changes in the pulse drive voltage on the change in the gate voltage is inhibited and the slope is reduced when the MOS type capacity element 28 is at the ON state. On the other hand, when the MOS type capacity element 28 is at the OFF state, the capacitance value is small and the influences due to changes in the pulse drive voltage is significant, resulting in a larger slope. Because a condition is set such that the larger slope is twice the smaller slope, an amount of reduction in the gate voltage when the pulse drive voltage becomes the L level and the MOS type capacity element 28 is at the OFF state is twice the amount of reduction when the MOS type capacity element 28 is at the ON state.

In actual practice, as shown in FIG. 3, when the switching voltage of the MOS type capacity element 28 (driver TFT 22) is at the switching voltage A, the gate voltage $V_{G22}$ is reduced with a first slope until the gate voltage $V_{G22}$ reaches the switching voltage A and then is reduced with a second slope which is twice the first slope. When, on the other hand, the switching voltage is at the switching voltage B, the gate voltage $V_{G22}$ is reduced with a first slope until the gate voltage $V_{G22}$ reaches the switching voltage B. A voltage difference $V\alpha$ between the gate voltage $V_{G22}$ when the gate voltage $V_{G22}$ reaches the switching voltage B and the gate voltage $V_{G22}$ when the switching voltage reaches the switching voltage A is a difference between the correction voltage VcA and the correction voltage VcB (VcB-VcA). Because the second slope is twice the first slope, $V\alpha$ is equal to the difference between the switching voltage A and the switching voltage B. Thus, the difference between the switching voltages and the difference between the correction voltages Vc becomes equal, to thereby allow compensation of influences of variation among the switching voltages (that is, the threshold voltages $V_{th22}$).

As shown in FIG. 3, even when the sampling voltage which is the write voltage of the data voltage changes, the difference between the switching voltages is equal to the difference between the correction voltages, and, thus, it is in all cases possible to compensate for the variation in threshold voltages. With this process, the potential difference of the sampling voltages themselves are amplified by a factor of 2 after the compensation operation.

Figure 4:
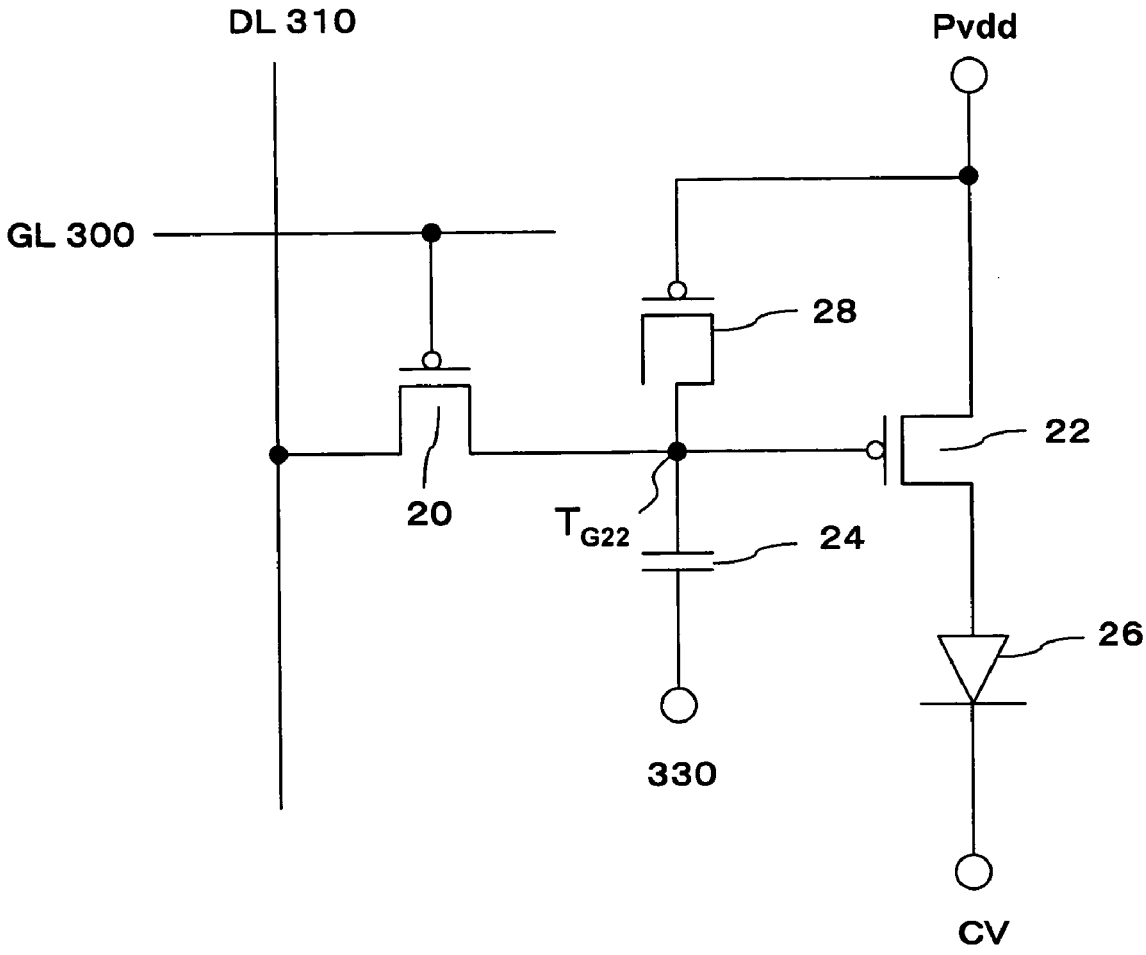
FIG. 4 is a diagram showing another structure of a pixel circuit according to another preferred embodiment of the present invention.

FIG. 4 shows an example structure of a pixel circuit which is closer to the reality. In this structure, an EL power supply Pvdd is connected to the gate of the MOS type capacity element 28.

In this example, the EL power supply Pvdd is set at 0 V, the cathode power supply CV is set at −12 V, the data line is set at 5 V-2 V, the pulse drive line is set at 8V-−4V, and the gate line is set at 8V-−4V. In addition, the capacitance value of the storage capacitor 24 is set at 0.15 pF, the channel length L of the MOS type capacity element 28 is set at 120 μm, the channel width W of the MOS type capacity element 28 is set at 5 μm, the channel length L of the driver TFT 22 is set at 34 μm, and the channel width W of the driver TFT is set at 5 μm.

Figure 5:
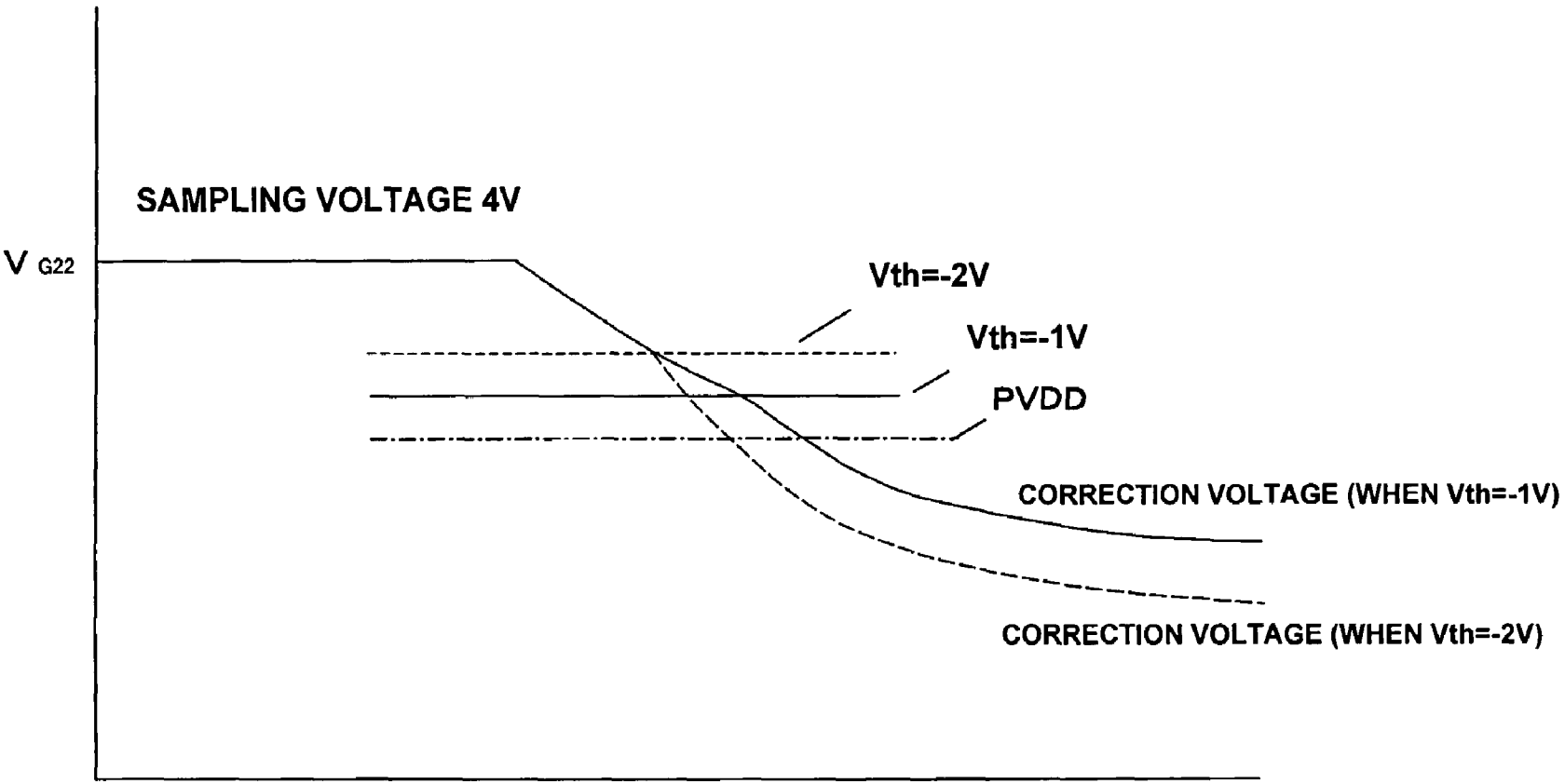
FIG. 5 is a diagram showing a change of states of a gate voltage.
Figure 6:
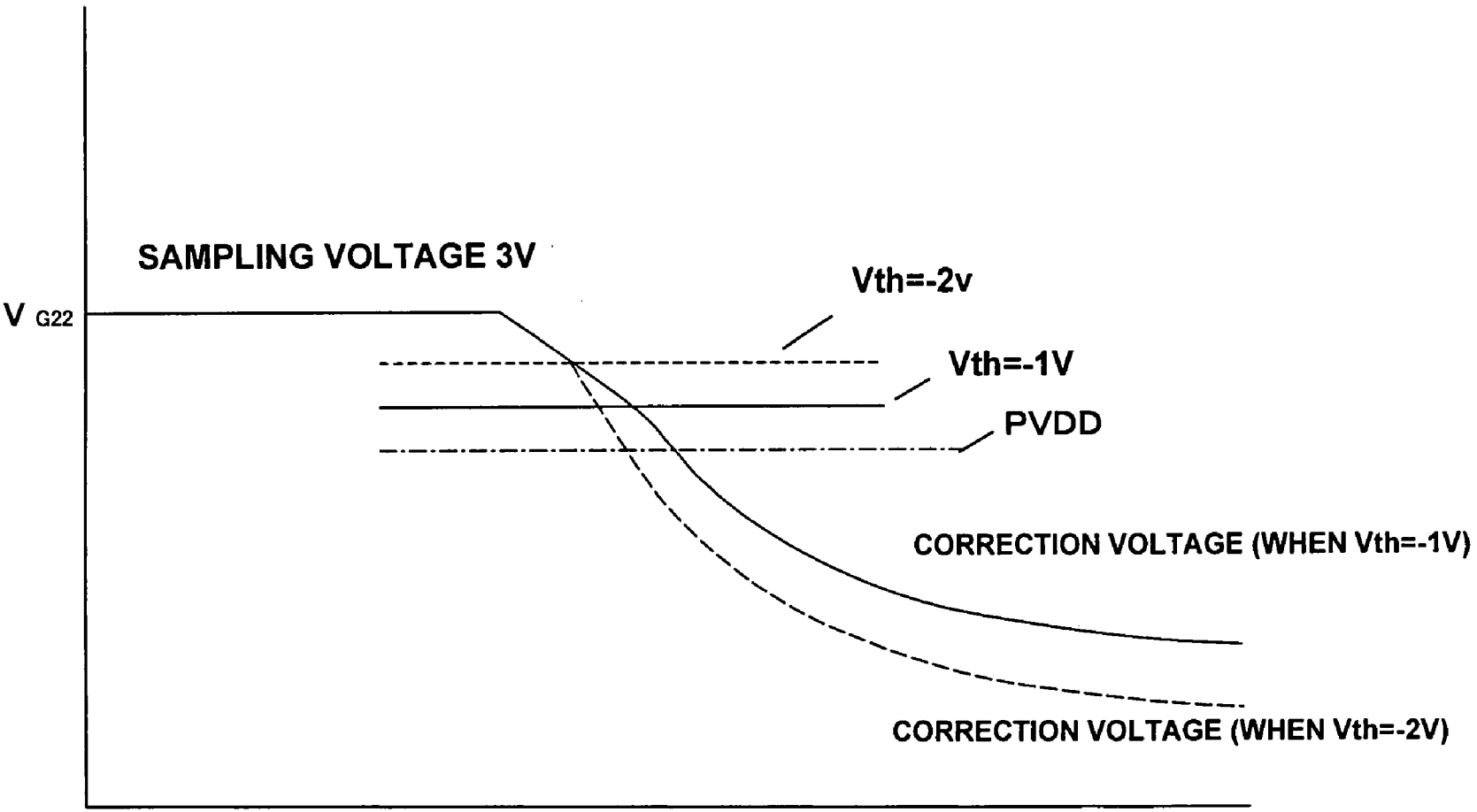
FIG. 6 is a diagram showing a change of states of a gate voltage.

In this structure, a scan signal of an L level is output onto the gate line GL:300 so that the switching TFT 20 which is of p-ch type in this example is switched on and a data voltage (sampling voltage) of 4 V or 3 V is written to a node $T_{G22}$ from a data line DL:310 through the TFT 20, that is, the gate voltage $V_{G22}$ is set at 4 V or 3 V. FIGS. 5 and 6 show changes of the gate voltage $V_{G22}$ when the pulse drive voltage falls from 8 V to −4 V after this process. FIG. 5 shows a configuration when the gate voltage is 4 V and FIG. 6 shows a configuration when the gate voltage is 3 V. In each of FIGS. 5 and 6, two cases, that is, a case when the threshold voltage $V_{th22}$ (=switching voltage) is −1 V and another case when the threshold voltage $V_{th22}$ is −2 V, are shown. It can be seen from FIGS. 5 and 6 that even when the sampling voltages are different and the threshold voltages $V_{th22}$ are different, because the gate voltage $V_{G22}$ of the driver TFT 22, and consequently, the correction voltage Vc also differs by the difference between the threshold voltages $V_{th22}$, the variation in the threshold voltages are compensated.

Figure 7:
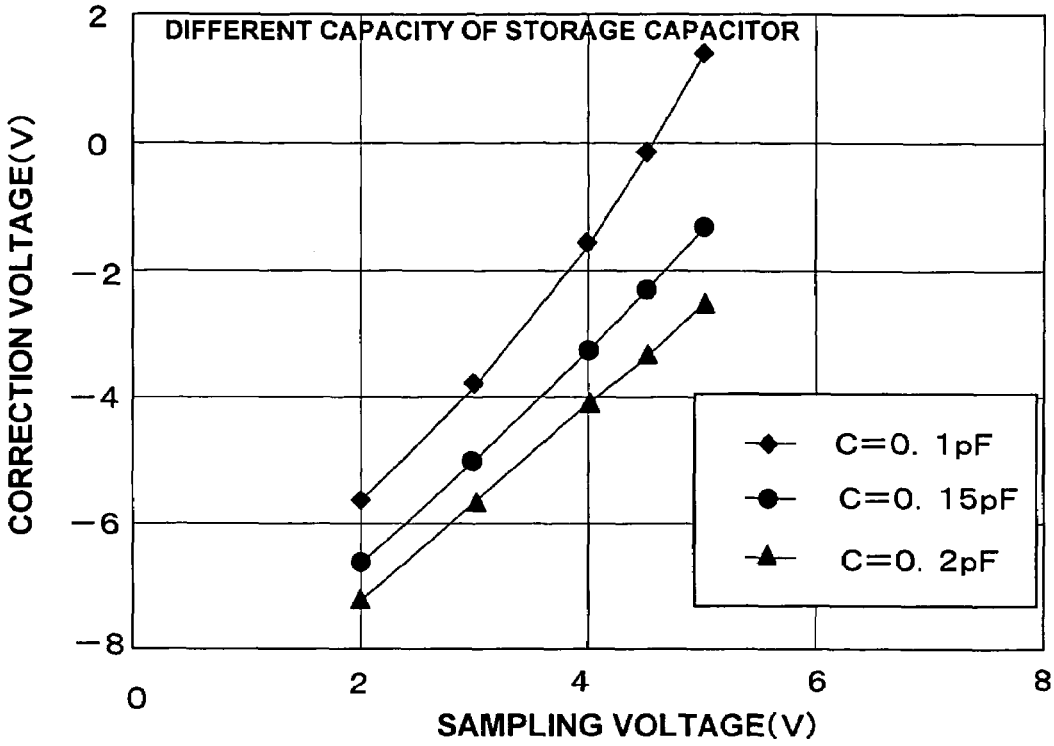
FIG. 7 is a diagram showing an influence of a storage capacitor on a correction voltage.
Figure 8:
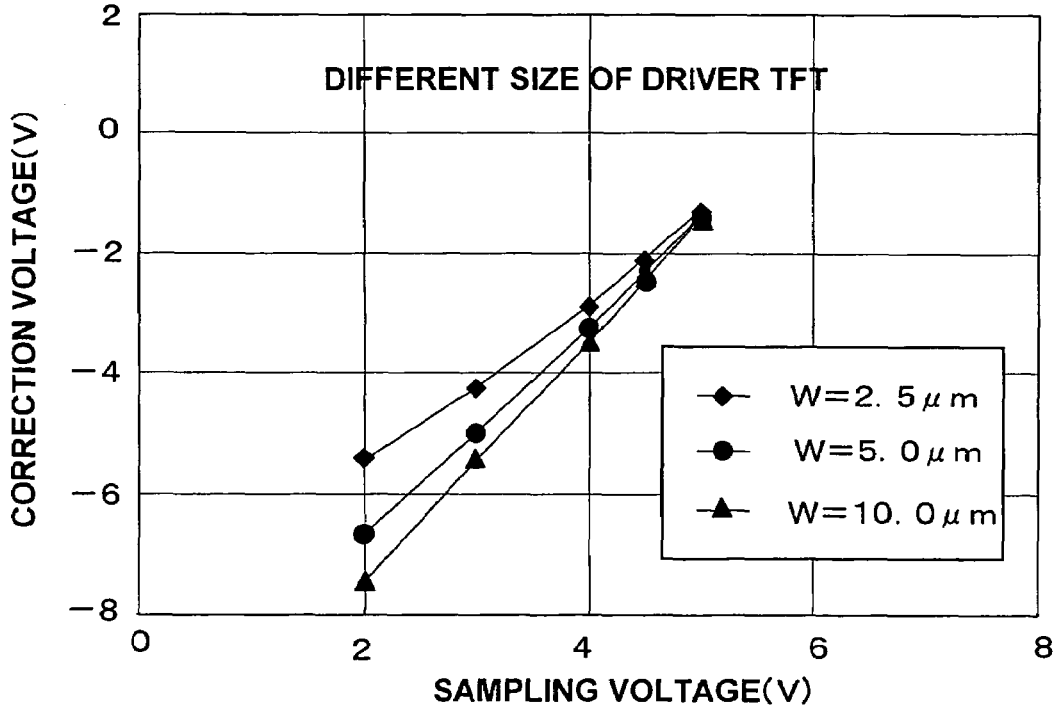
FIG. 8 is a diagram showing an influence of a gate width of a driver TFT on a correction voltage.
Figure 9:
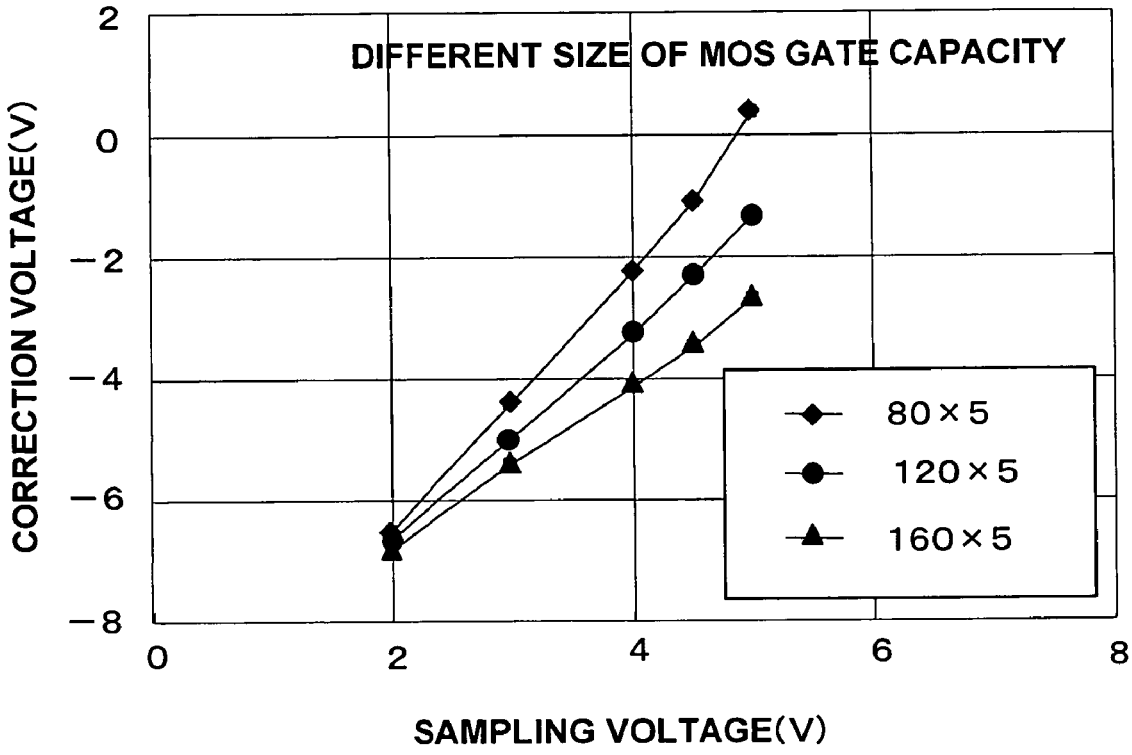
FIG. 9 is a diagram showing an influence of a gate length of a MOS type capacity element on a correction voltage.

FIG. 7 shows a relationship between a change in a sampling voltage and a change in the correction voltage Vc (gate voltage $V_{G22}$) when the channel length L and the channel width W of the driver TFT 22 are set at 34 μm and 5 μm respectively, the channel length L and the channel width W of the MOS type capacity element 28 are set at 120 μm and 5 μm, respectively, and the capacitance value of the storage capacitor 24 is changed from 0.1 pF to 0.15 pF and further to 0.2 pF. FIG. 8 shows a relationship between a change in a sampling voltage and a change in the correction voltage Vc (gate voltage $V_{G22}$) when the channel length L of the driver TFT 22 is set at 34 μm, the channel length L and the channel width W of the MOS type capacity element 28 are set at 120 μm and 5 μm, respectively, the capacitance value of the storage capacitor 24 is set at 0.15 pF, and the channel width W of the driver TFT 22 is changed from 2.5 μm to 5.0 μm and further to 10.0 μm. FIG. 9 shows a relationship between a change in a sampling voltage and a change in the correction voltage Vc (gate voltage $V_{G22}$) when the channel length L and the channel width W of the driver TFT 22 are set at 34 μm and 5 μm respectively, the channel length L and the channel width W of the MOS type capacity element 28 are changed from 80 μm and 5 μm to 120 μm and 5 μm and further to 160 μm and 5 μm. As can be seen from FIGS. 7, 8, and 9, it is possible to adjust the change in the correction voltage by changing conditions such as the capacitance value of the storage capacitor, the size of the driver TFT 22, and the size of the MOS type capacity element 28. In other words, the degree of compensation of the gate voltage $V_{G22}$ can be adjusted through setting of these conditions.

Moreover, it can also be seen from FIGS. 7-9 that a width of the change of the correction voltage $V_{G22}$ (output voltage)

is larger than a width of the change of the sampling voltage (input voltage). Depending on the setting of the conditions, the width of change of the correction voltage can be significantly increased. Therefore, it is possible to obtain a larger width of change of the gate voltage $V_{G22}$ than the width of the change of a video signal, to thereby allow a width of change of the drive current to be supplied through the organic EL element 26, that is, the brightness change of the organic EL element 26, to be large and to achieve a display with higher clarity.

Figure 10:
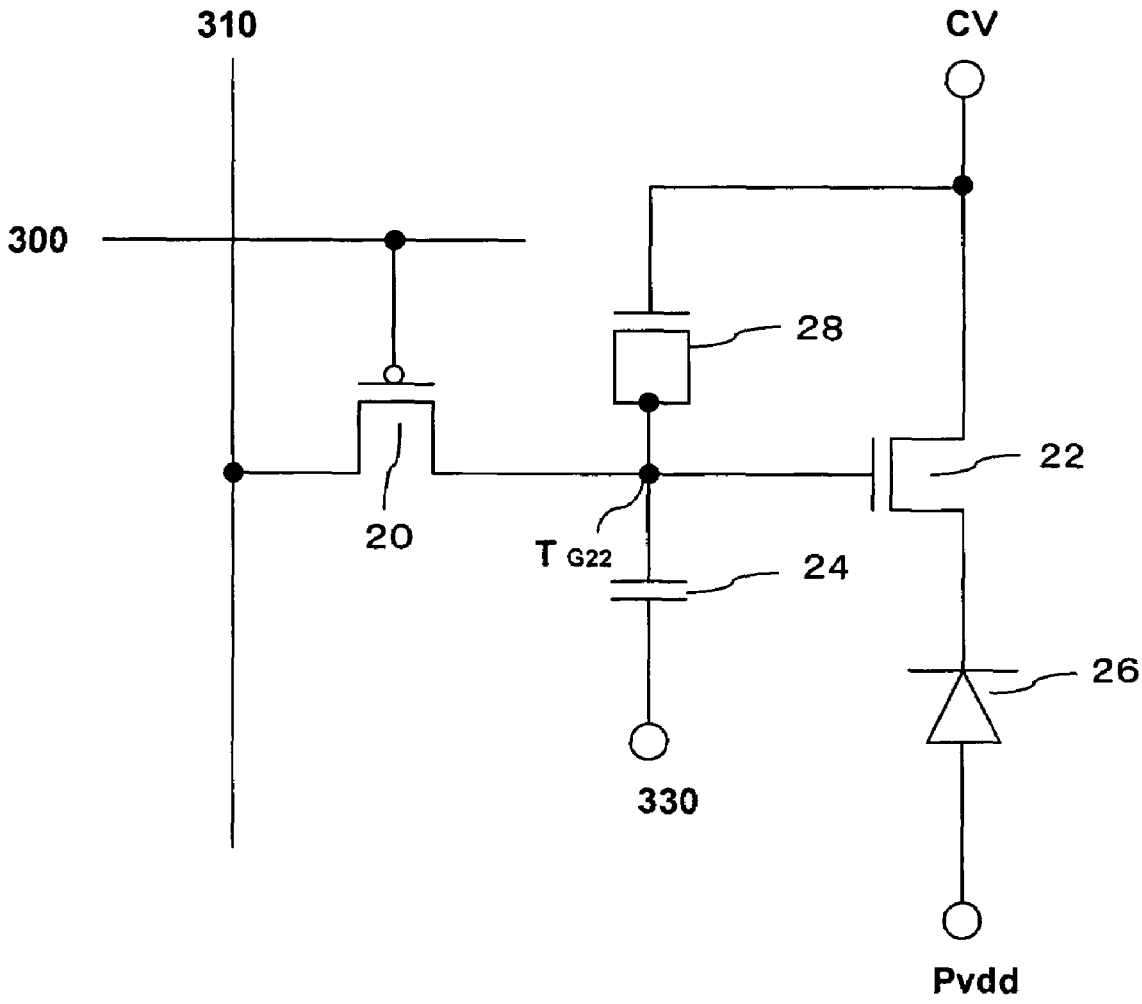
FIG. 10 is a diagram showing a structure of a pixel circuit according to another preferred embodiment of the present invention.

In the example structures of FIGS. 1 and 4, a p-channel TFT is used as the switching TFT 20. Alternatively, an n-channel TFT may be used. In such a case, the polarity of a selection signal (scan signal) to be output onto the gate line GL:300 is inverted. Similarly, it is also possible to use an n-channel TFT for the driver TFT 22. In this case, as shown in FIG. 10, the MOS type capacity element 28 is also formed of an n-channel structure and the gate of the MOS type capacity element 28 is connected to the source of the driver TFT 22. In addition, in this structure, it is desirable to place the organic EL element 26 between the drain of the driver TFT 22 and the EL power supply.

AS described, the pixel circuits according to the present embodiment are arranged in a matrix form and a display device is formed. In general, a peripheral driver circuit and a pixel circuit other than the organic EL element are formed on an insulating substrate such as glass, and then, an organic EL element is formed above the circuit elements and the organic EL panel is formed. The pixel circuit of the present embodiment, however, is not limited to this type of organic EL panel, and may be applied to various display devices.

Figure 11:
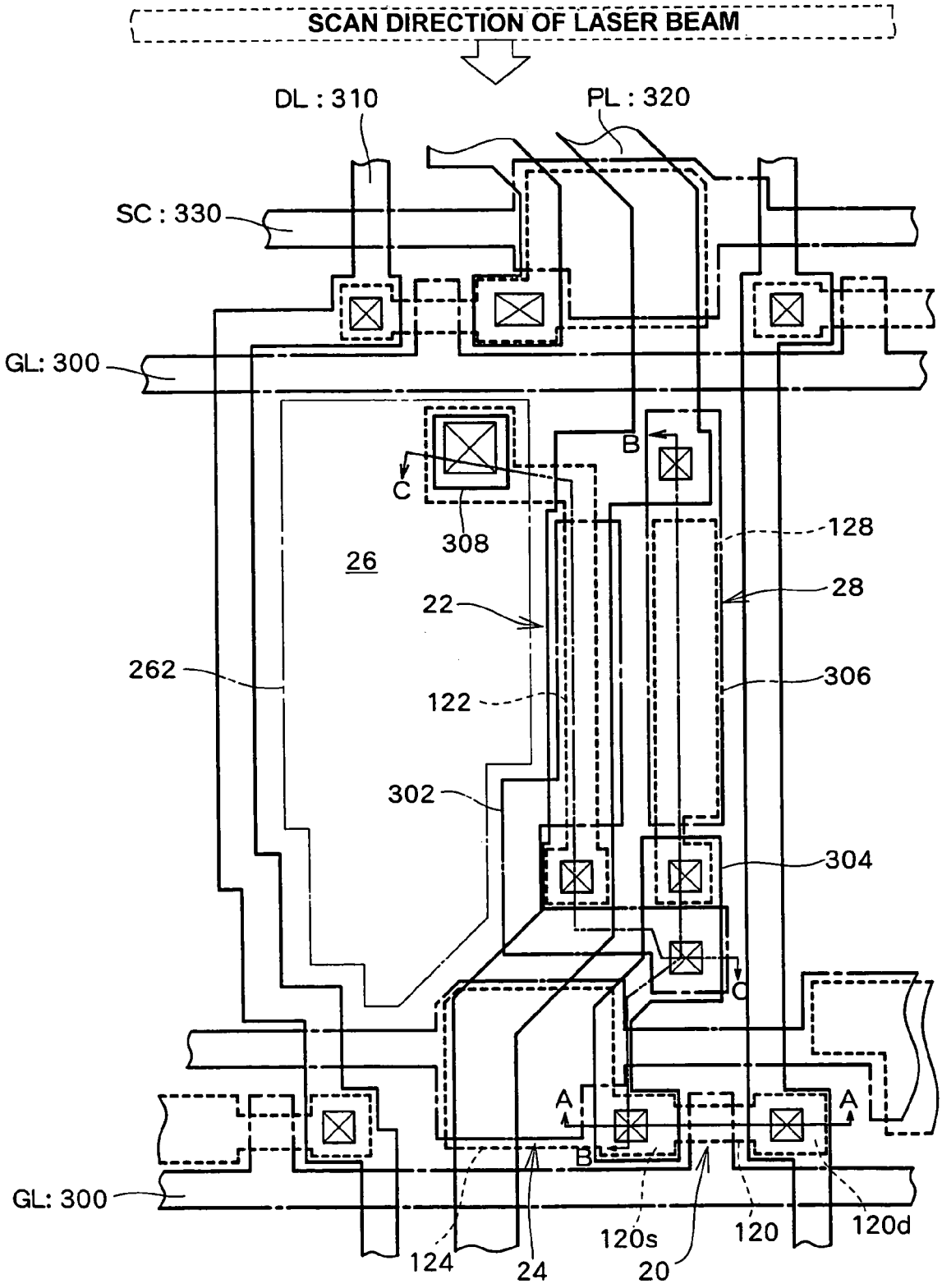
FIG. 11 is a plan diagram showing a structure of a pixel according to a preferred embodiment of the present invention.
Figure 12A:
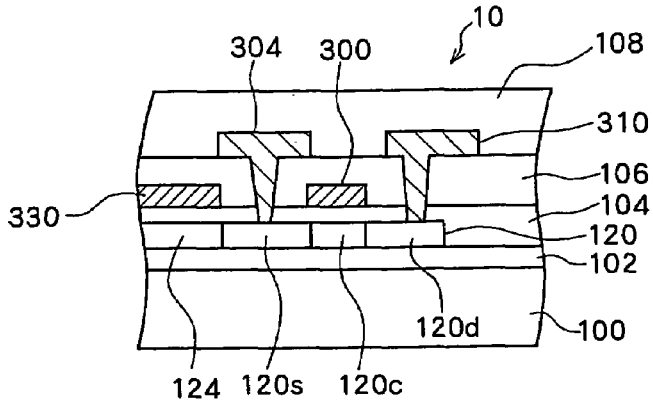
FIGS. 12A, 12B and 12C are diagram schematically showing a cross sectional structures of the pixel of FIG. 11.
Figure 12B:
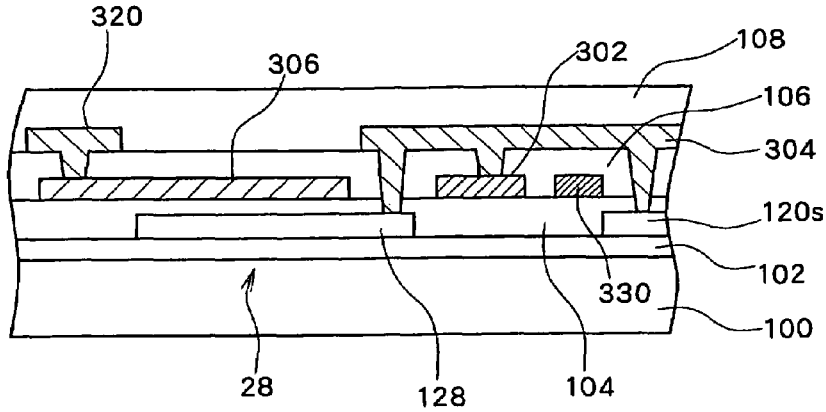
Figure 12C:
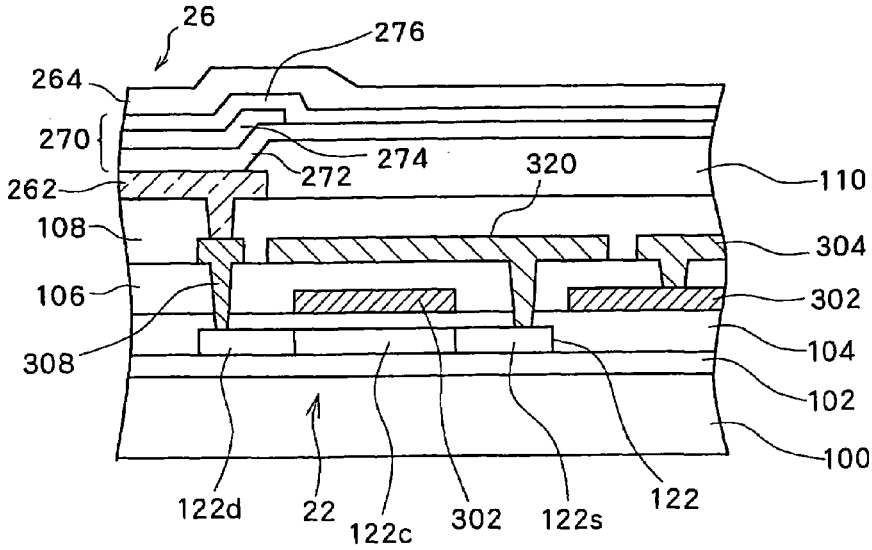

FIG. 11 shows an example of an actual layout when a circuit structure as shown in FIG. 4 is to be realized. FIGS. 12A, 12B, and 12C show respectively schematic cross sectional structures along an A-A line, a B-B line, and a C-C line of FIG. 11. A buffer layer 102 is formed over a transparent insulating substrate 100 such as glass. An active layer of each TFT and a semiconductor layer which forms a capacitor electrode (120, 122, 128, and 124), both of which are made of polycrystalline silicon, are formed over the buffer layer 102 and are shown in FIG. 11 with a dotted line. In FIG. 11, a gate line 300 (GL), a pulse drive line 330 (SC), a gate electrode 302 of a driver TFT and a gate electrode 306 of the MOS type capacity element which are formed above the semiconductor layer and in which a high melting-point metal (refractory) material such as Cr is used are shown with a dotted chain line. A data line 310 (DL), a power supply line 320 (PL), and other metal wirings 304 of the same layer which are formed above the semiconductor layer, gate line GL, and pulse drive line SC and in which a low resistance metal material such as Al is used are shown by a solid line.

In the layout shown in FIG. 11, each pixel is formed between rows of gate lines GL:300 which are formed along a horizontal (H) direction of the display device and between columns of data lines DL:310 which are formed approximately along a vertical (V) direction of the display device.

A power supply line PL for supplying power, through a driver TFT 22, to the organic EL element 26 in the pixels along the column direction and the data line DL and connected to the data line DL is formed along the column direction approximately along the data line DL:310. In each pixel region, the power supply line PL:320 extends in a region between the data line DL and the organic EL element 26.

A switching TFT 20 is formed near an intersection of a gate line GL and a data line DL. A semiconductor layer 120 of the switching TFT 20 is formed along the gate line GL. The TFT 20 is formed such that the channel length direction is along the gate line GL, that is, along the horizontal direction. A projection is formed which projects from the gate line GL towards the pixel region and covers, in a crossing manner, a portion of the semiconductor layer 120 extending along the gate line GL with a gate insulating film 104 therebetween.

The projection from the gate line GL forms a gate electrode 300 of the TFT 20 and a region of the semiconductor layer 120 covered by the gate electrode 300 forms a channel region. The semiconductor layer 120 of the switching TFT 20 is connected to the data line DL through a contact hole formed through the gate insulating film 104 and an interlayer insulating film 106. A conductive region (for example, a source region 120*s*) of the semiconductor layer 120 which is present on a side opposite from the conductive region (for example, a drain region 120*d*) of the semiconductor layer 120 which is connected to the data line DL with the channel region 120*c* therebetween is connected to a metal wiring 304 formed above the interlayer insulating film 106 through a contact hole formed through the gate insulating film 104 and the interlayer insulating film 106. The semiconductor layer 120 further extends from the contact position along the horizontal and vertical directions and ends before the adjacent pixel, in the shown structure, near an end of an overlapping region with the power supply line PL.

The region of the semiconductor layer 120 extending beyond the contact position with the metal wiring 304 functions as a capacitor electrode 124 which overlaps, with the gate insulating film 104 interposed, a wide-width region of a pulse drive line 330 (SC) placed along the horizontal direction in parallel with the gate line GL. The overlap region between the capacitor electrode 124 and the pulse drive line 330 functions as a storage capacitor 24.

The metal wiring 304 to which a part of the source region 120*s* of the switching TFT 20 up to the storage capacitor electrode 124 is connected through a contact hole is formed as the same layer as the data line DL, etc. In the configuration shown in FIG. 11, the metal wiring 304 extends from the contact position along the vertical direction similar to and between the data line DL and the power supply line PL which extend alongside each other. As shown in FIG. 12B, the metal wiring 304 extends across and above the pulse drive line SC which extends with an interlayer insulating film 106 therebetween and ends at a position which overlaps a region in which a semiconductor layer 128 of a MOS type capacity element 28 which will be described below is formed. The metal wiring 304 is connected to the semiconductor layer 128 through a contact hole formed through the interlayer insulating film 106 and the gate insulating film 104.

The metal wiring 304 is also connected to a gate electrode wiring 302 which forms a gate electrode of a driver TFT 22 and which is formed of a metal layer of an identical material as the gate line GL or the like, through a contact hole formed through the interlayer insulating film 106 in a position between a contact position between the metal wiring 304 and the semiconductor layer 120 of the switching TFT 20 (source region 120*s*) and a contact position between the metal wiring 304 and the semiconductor layer 128 of the MOS type capacity element 28.

As shown in FIG. 11, in order to detour around the contact region between the power supply line PL and the semiconductor layer 122 of the driver TFT 22, the gate electrode wiring 302 extends from the contact position with the metal wiring 304 along the horizontal direction and below the power supply line PL, is bent at a position beyond the overlap region between the gate electrode wiring 302 and the power supply line PL, and extends along the vertical direction alongside the power supply line PL. Then, the gate electrode wiring 302 is bent to be along the horizontal direction so as to overlap with the power supply line PL (to the right in FIG. 11) and extends again along the vertical direction from the overlap position with the power supply line PL, below the power supply line PL, overlapping with the semiconductor layer 122 of the driver TFT 22 as shown in FIG. 12C. A region in which the gate electrode wiring 302 opposes the semiconductor layer 122 below the gate electrode wiring 302 with the gate insulating film 104 therebetween forms a gate electrode of the driver TFT 22 and a channel region 122*c* is formed in a region of the semiconductor layer 122 covered by the gate electrode.

The semiconductor layer 122 of the driver TFT 22 extends along the vertical direction and a large portion of the formation region of the semiconductor layer 122 is placed below the power supply line PL. A conductive region (in the shown structure, the source region 122*s*) of the semiconductor layer 122 is connected to the power supply line PL, which is formed to cover above the conductive region of the semiconductor layer 122, through a contact hole formed through the interlayer insulating film 106 and the gate insulating film 104. In addition, a conductive region (in the shown structure, a drain region 122*d*) formed at a position opposite to the source region 122*s* with the channel region 122*c* therebetween protrudes from the formation region of the power supply PL near the gate line GL of the next row and is connected to a lower electrode (in the shown configuration, an anode) 262 of an organic EL element 26. Therefore, the channel length direction of the driver TFT 22 is parallel with the vertical direction which is an extension direction of the power supply line PL.

As shown in FIG. 12C, the organic EL element 26 has an emissive element layer 270 between a lower electrode 262 and an upper electrode 264. In the shown configuration, the emissive element layer 270 has a three-layered structure including a hole transport layer 272, an emissive layer 274, and an electron transport layer 276. The emissive element layer 270, however, is not limited to the three-layered structure, and may be of a single layer having light emission functionality or a layered structure of 2 or 4 or more layers, depending on the organic material or organic materials to be used.

A first planarizing insulating layer 108 made of an organic resin or the like is formed over almost the entire substrate, covering the overall formation plane of the data line DL, power supply line PL, etc. A lower electrode 262 of the organic EL element 26 is formed above the first planarizing insulating film 108 individually for each pixel region using a transparent conductive metal oxide material such as ITO. The lower electrode 262 of the organic EL element 26 is connected, through a contact hole formed through the first planarizing insulating film 108, to a drain electrode 308 which is connected to the drain region 122*d* of the driver TFT 22.

The upper electrode 264 formed to oppose the lower electrode 262 with the emissive element layer 270 therebetween in the shown configuration is formed to be common to all pixels, and may be formed using a material such as, for example, a metal material such as Al and a conductive transparent material such as ITO.

As shown in FIG. 12C, a second planarizing insulating film 110 is formed above the first planarizing insulating film 108 to cover end portions of the lower electrode 262 and the emissive element layer 270 is formed to cover above an exposed surface of the lower electrode 262 and the second planarizing insulating film 110.

When a multiple layer structure is to be employed as the emissive element layer 270, it is also possible to form all layers to be common for each pixel. Alternatively, it is also possible to form some of or all of the plurality of layers in individual pattern(s) for each pixel similar to the lower electrode 262 such as shown in FIG. 12C, for example, in which only the emissive layer 274 is formed in an individual pattern.

The MOS type capacity element 28 is formed near the driver TFT 22 connected between the organic EL element 26 having the above-described structure and the power supply line PL. A gate electrode 306 of the MOS type capacity element 28 is connected to the power supply line PL through a contact hole formed through the interlayer insulating film 106 (refer to FIG. 12B and extends straight along the vertical direction from this contact position. The semiconductor layer (active layer) 128 of the MOS type capacity element 28 is formed extending in a vertical direction in parallel with the semiconductor layer 122 of the driver TFT 22 from the contact position with the metal wiring layer 304 to oppose the gate electrode 306 with the gate insulating film 104 therebetween.

As described, although the semiconductor layer 128 of the MOS type capacity element 28 has one side connected to the gate electrode 302 of the driver TFT 22, the source region 120*s* of the switching TFT 20, and the storage capacitor electrode 124 through the metal wiring layer 304, the other side of the semiconductor layer 128 is electrically open. That is, as shown in FIG. 4, in the semiconductor layer 128 of the MOS type capacity element 28, both regions corresponding to a source region and a drain region if the MOS type capacity element 28 is considered as a TFT are connected to the source region 120*s* of the switching TFT 20, the storage capacitor 24, and the gate electrode 302 of the driver TFT 22 through the metal wiring layer 304.

By forming the power supply line PL bending towards the organic EL element 26 within a pixel region and forming a MOS type capacity element 28 in the space created between the power supply line PL and the data line DL, it is possible to form the MOS type capacity element 28 at a position near the driver TFT 22, to thereby match the characteristics of both the MOS type capacity element 28 and the driver TFT 22. In addition, the channel length direction of the driver TFT 22 and the channel length direction (a direction of overlap and extension of the gate electrode 306 and the semiconductor layer 128) of the MOS type capacity element 28 are both along the vertical direction and the channel regions of the driver TFT 22 and of the MOS type capacity element 28 are formed at approximately the same position in the vertical direction.

Thus, when, for example, an amorphous silicon film is formed and then is irradiated with laser beam for polycrystallization and the polycrystallized silicon film is used as the active layer of the TFT, the channel region of the MOS type capacity element 28 and the channel region of the driver TFT 22 which have significant influences on the TFT characteristics are polycrystallized with approximately the same laser beam irradiation. In particular, when the polycrystallization is achieved by scanning the silicon film with a line-shaped (linear) laser beam along the vertical direction, the channel regions are polycrystallized with approximately the same laser beam. Thus, it is possible to obtain very similar characteristics for the driver TFT 22 and the MOS type capacity element 28.

Figure 13:
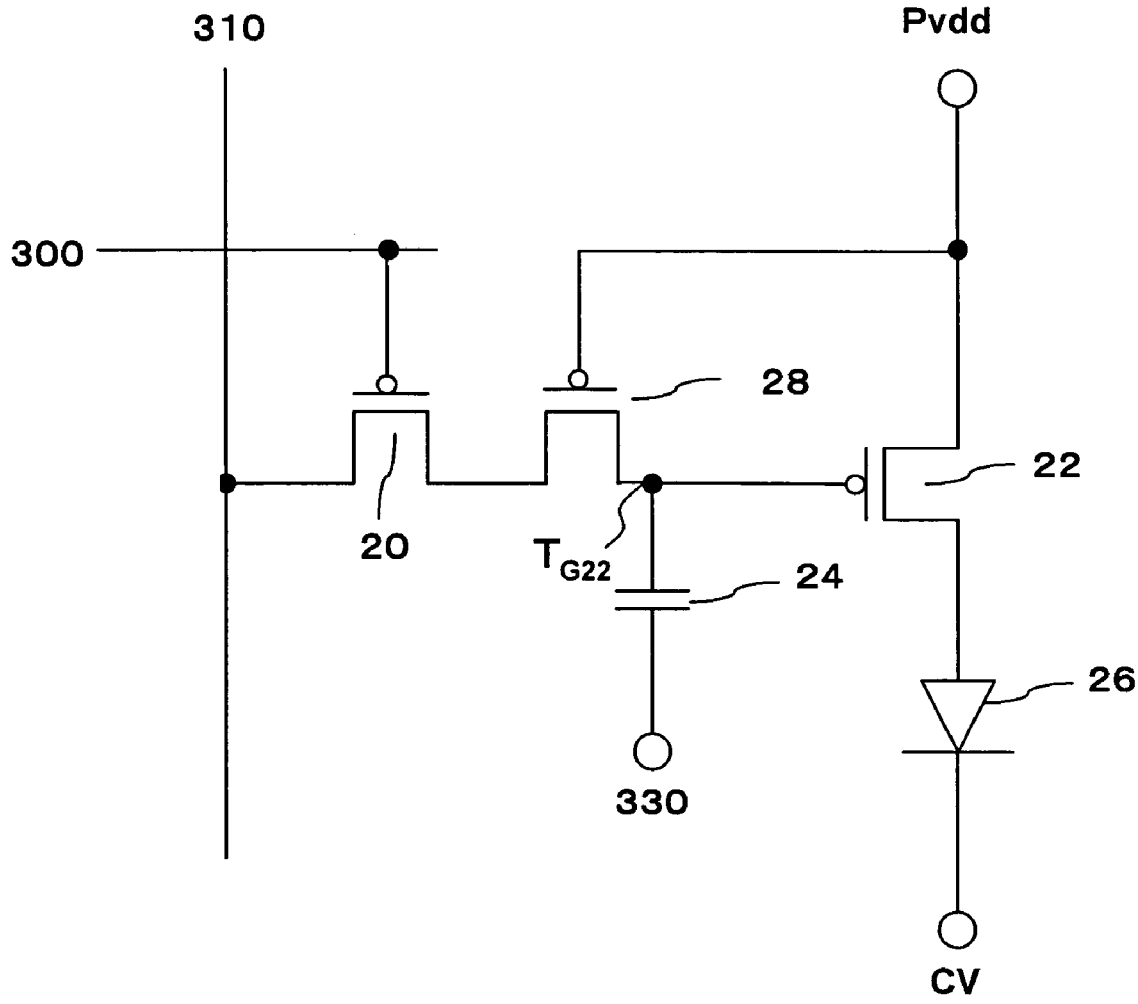
FIG. 13 is a diagram showing a structure of a pixel circuit according to another preferred embodiment of the present invention.
Figure 14:
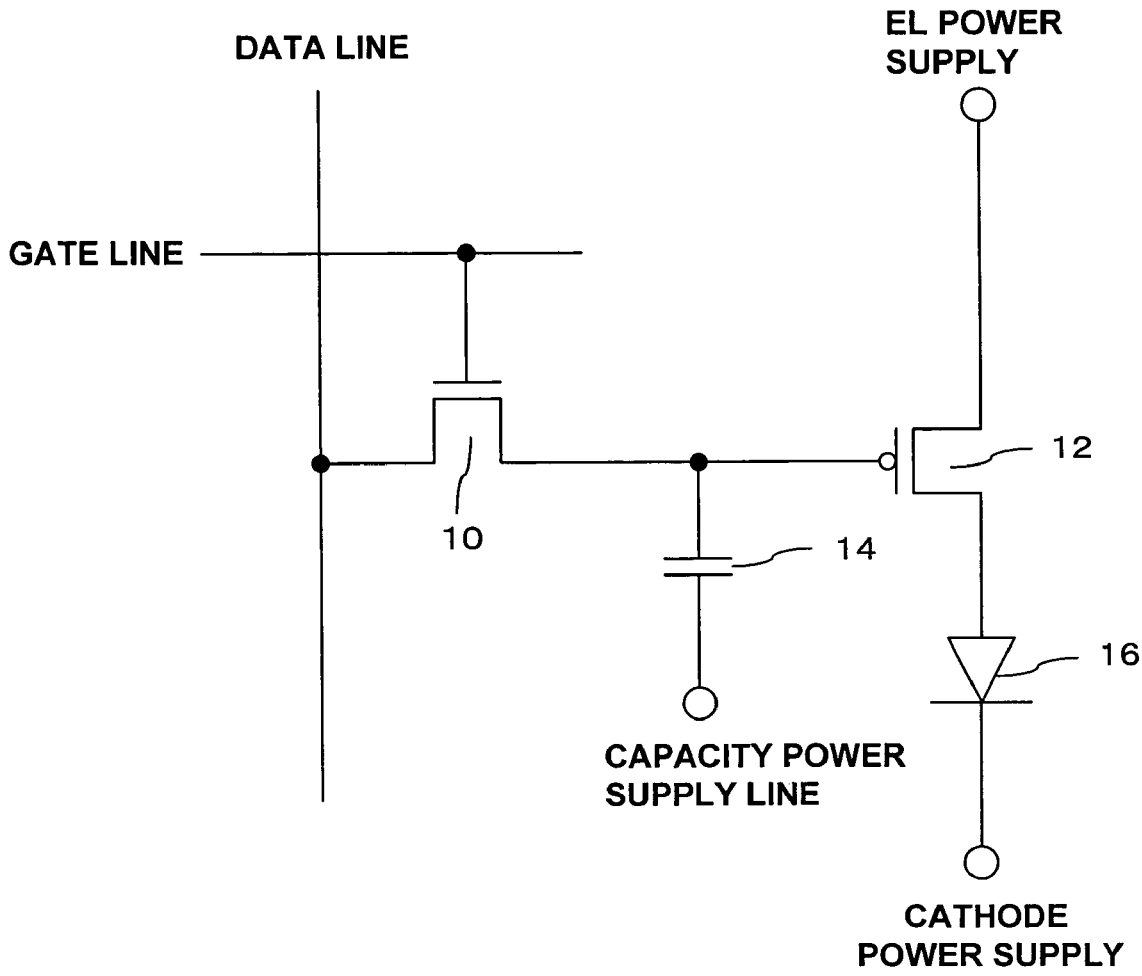
Fig. 14 PRIOR ART
FIG. 14 is a diagram showing a structure of a conventional pixel circuit.

FIG. 13 shows another preferred embodiment of the present invention. The configuration shown in FIG. 13 differs from that shown in FIG. 4 in that the source of the MOS type capacity element 28 is connected to the drain of the switching TFT 20 and the drain of the MOS type capacity element 28 is connected to the gate of the driver TFT 22. In other words, in this preferred embodiment, the MOS type capacity element 28 is a p-channel MOS transistor.

Also with such a structure, the MOS type capacity element 28 is switched on during when the voltage on the pulse drive line is high, and the state of the MOS type capacity element 28 changes from the ON state to the OFF state when the voltage on the pulse drive line is decreased. Thus, the capacity of the MOS type capacity element 28 changes, and advantages similar to the above-described embodiment can be obtained.

The present invention can be applied to a pixel circuit or the like in a display device.

What is claimed is:

1. A pixel circuit comprising:

a storage capacitor for receiving a data voltage on a first electrode and storing the data voltage;

a driver transistor having its gate connected to the first electrode of the storage capacitor wherein an amount of current is controlled based on a voltage on the first electrode of the storage capacitor;

an emissive element which emits light corresponding to a current flowing though the driver transistor;

a first control signal line connected to a second electrode of the storage capacitor and to which a predetermined voltage or pulse-shaped signal is input; and a MOS type capacity element having a first electrode connected to a gate of the driver transistor and a second electrode connected to a second control signal line to which a predetermined voltage or pulse-shaped signal is input, wherein a capacitance of the MOS type capacity element changes in response to a change in voltage on the first or second control signal line;

wherein at least one of a source and a drain of the MOS type capacity element is connected to the gate of the driver transistor and a gate of the MOS type capacity element is connected to the second control signal line.

2. A pixel circuit according to claim 1, wherein after the data voltage is stored in the storage capacitor, the MOS type capacity element is changed from an ON state to an OFF state by changing a voltage on the first or second control signal line.

3. A pixel circuit according to claim 2, wherein the MOS type capacity element has a threshold voltage similar to that of the driver transistor.

4. A pixel circuit according to claim 3, wherein one of a source and a drain of the MOS type capacity element is connected to a side of a supply source of a data signal and another one of the source and the drain is connected to the gate of the driver transistor, and a gate of the MOS type capacity element is connected to the second control signal line.

5. A pixel circuit according to claim 4, wherein the MOS type capacity element is changed from an ON state to an OFF state and the driver transistor is changed from an OFF state to an ON state by changing a voltage on the first or second control signal line to allow the emissive element to emit light.

6. A pixel circuit according to claim 5, wherein a drive power supply line which is connected to the driver transistor also functions as the second control signal line.

7. A pixel circuit according to claim 1, wherein the MOS type capacity element is changed from an ON state to an OFF state and the driver transistor is changed from an OFF state to an ON state by changing a voltage on the first or second control signal line to allow the emissive element to emit light.

8. A pixel circuit according to claim 7, wherein a drive power supply line which is connected to the driver transistor also functions as the second control signal line.

9. A display device wherein a plurality of pixel circuits according to claim 1 are provided in a matrix form.

10. A pixel circuit according to claim 1, wherein the driver transistor and the MOS type capacity element are p-channel thin film transistors.

11. A pixel circuit according to claim 1, wherein the emissive element is an electroluminescence element.

* * * * *